United States Patent [19]

Dixon

[11] 4,122,632

[45] Oct. 31, 1978

[54] DRAUGHT AND WEATHER SEALING ARRANGEMENTS

[75] Inventor: Bernard Dixon, Pampisford, England

[73] Assignee: Dixon International Limited, Pampisford, England

[21] Appl. No.: 776,611

[22] Filed: Mar. 11, 1977 (Under 37 CFR 1.47)

[30] Foreign Application Priority Data

Mar. 11, 1976 [GB] United Kingdom ..... 9757/76

[51] Int. Cl.[2] ..... E06B 1/70

[52] U.S. Cl. ..... 49/470

[58] Field of Search ..... 49/469, 470, 475, 485

[56] References Cited

U.S. PATENT DOCUMENTS

| | | | |
|---|---|---|---|
| 180,683 | 8/1875 | Watkins | 49/470 X |
| 3,796,006 | 3/1974 | Dixon | 49/469 X |

FOREIGN PATENT DOCUMENTS

| | | | |
|---|---|---|---|
| 1,158,659 | 7/1969 | United Kingdom | 49/475 |
| 1,234,758 | 6/1971 | United Kingdom | 49/470 |

*Primary Examiner*—Kenneth Downey

*Attorney, Agent, or Firm*—Weingarten, Maxham & Schurgin

[57] ABSTRACT

A weather sealing arrangement for a gap between first and second elongate structural members of which a door equipped with a weatherboard, and a sill, are examples, in which the weatherboard supports an elongate seal therealong which has a resiliently supported protruding portion for sealing a gap between the weatherboard and the sill when the door is in a closed condition, and the sill provides a weather strip which extends along the sill and protrudes therefrom. During hingeing movement of the door from the closed condition to an open condition, the protruding seal passes through an intermediate condition in which the seal portion traverses the weather strip so that the whole length of the seal portion is wiped by the weather strip and rainwater will tend to be wiped off the seal portion and so be kept outdoors. The weather strip is in the form of a rib which may be elastomeric and removably secured to the sill, or formed on it and be moulded with the sill. In the closed condition the seal portion and rib may be backed up by the door; the seal portion may seal against the rib, or the sill, or both the rib and the sill.

15 Claims, 4 Drawing Figures

DRAUGHT AND WEATHER SEALING ARRANGEMENTS

Figure 1:
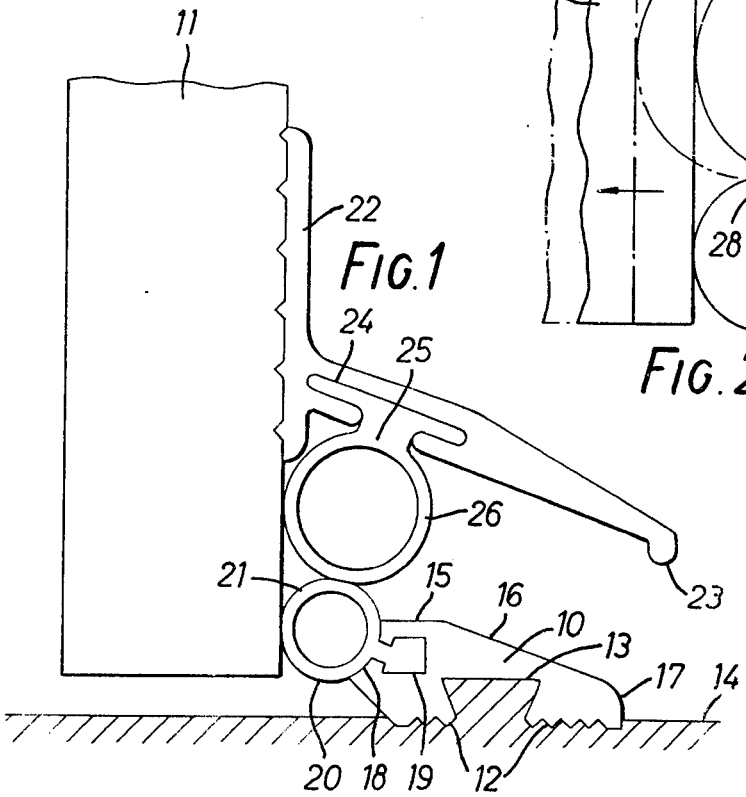

This invention relates to draught and weather sealing arrangements.

More particularly, the invention relates to a weather sealing arrangement for a gap between the first and second elongate structural members which are relatively movable transversely of each other with consequential opening and closing of the gap, the first member supporting an elongate seal therealong which has a resiliently supported protruding portion for sealing the gap when the first and second members are in a closed condition, and the second member providing a weather strip which extends along the second member and protrudes therefrom, in which arrangement the protruding seal portion, during relative transverse movement of the first and second members from the closed condition to an open condition, passes through an intermediate condition in which the seal portion traverses the weather strip so that the whole length of the seal portion is wiped by the weather strip.

The structural members may be of a door, for example the bottom rail or the weatherboard, top rail or the stiles; sill, head or jambs of the door case; or equivalent of a casement window. Where reference is made hereinafter to a door it is to be understood to include a reference to a casement window.

U.S. Pat. No. 2,549,284 and British Pat. Specification No. 1,234,758 propose weather excluding arrangements. Each proposes to use a rigid, wide, substantially flat weather strip which is secured to lie horizontally on a sill or floor adjacent to the bottom rail of a door. A horizontally supported elastomeric strip is retained on the weather side of the bottom rail and seals adjacent to or against the rigid strip when the door is in a closed condition. When the door is being opened, or nearing the closed condition, the whole length of the elastomeric strip is simultaneously in contact with and wipes the flat top of the rigid strip. These prior arrangements give rise to friction which tends to make the door stiff to close fully and to open. Moreover, these prior arrangements are such that if the bottom edge of the elastomeric seal is raised slightly to reduce the friction, some of the ability to keep out wind and rain would be lost.

An object of the present invention is to minimise the stiffness in closing the door fully and in opening it, without losing the effectiveness of the sealing arrangement in keeping out rainwater.

The present invention resides in providing a weather strip in the form of a rib which will wipe the whole length of the aforementioned seal portion when the seal portion passes through the intermediate condition from the closed condition.

The seal portion mentioned may seal against the rib and/or the second member when the first and second members are in the closed condition. Furthermore, the seal/and or rib may be elastomeric, for example of neoprene, and tubular.

When the invention is applied to a sealing arrangement for a sill and a door which is equipped with a weatherboard, the weatherboard supports an elongate seal therealong which has a resiliently supported protruding portion for sealing a gap between the weatherboard and the sill when the door is in a closed condition, and the sill provides a rib which extends along the sill and protrudes therefrom, and the protruding seal portion, during hingeing movement of the door from the closed condition to an open condition, passes through an intermediate condition in which the seal portion traverses the rib so that the whole length of the seal portion is wiped by the rib.

Figure 2:
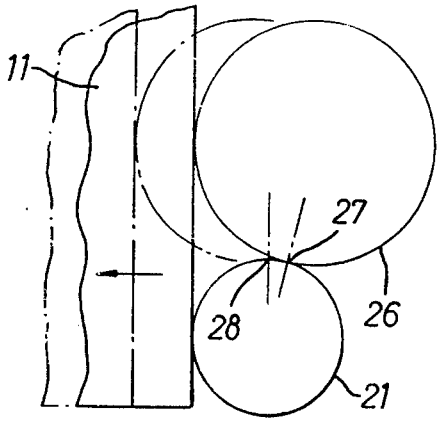
Figure 3:
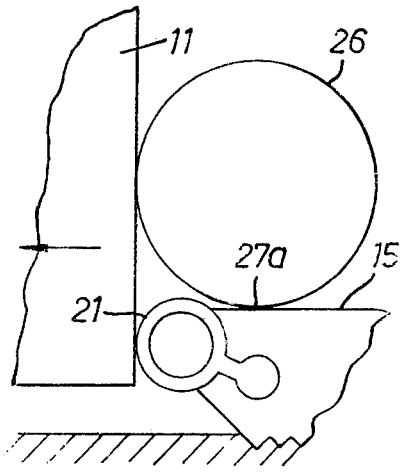
Figure 4:
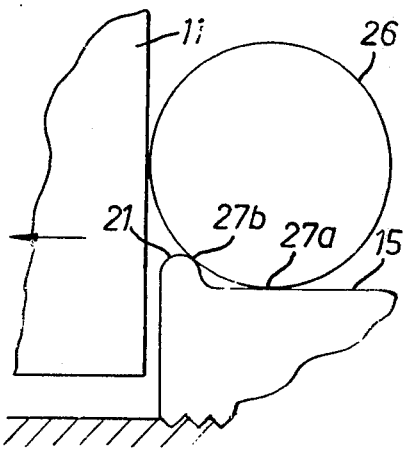

An example according to the invention, of weatherboard and sill sealing, will now be described with reference to the accompanying drawing in which FIG. 1 shows an end elevation of a closed door (fragmentary view) and a sill;

FIG. 2 is a diagram on a larger scale, indicating contact positions of elastomeric elements carried by the door and sill; and FIGS. 3 and 4 are fragmentary diagrams indicating alternative contact positions.

In the drawing, an elongate strip, which may be of rigid plastics material, provides a sill 10 to a door 11. The underside of the sill may be provided, as shown, with ridges and furrows 12 and a dovetail groove 13 for keying the sill to a cement or concrete foundation 14. The upper side of the sill has a horizontal tread 15 adjacent to the door, and a steady slope 16 downward to a round bevel 17 at the weather-side of the sill. The rear or inner side of the sill is partly concave at 18, being part-cylindrical as shown, and formed therein with a longitudinally extending groove 19.

The groove 19 removably retains an elastomeric element 20 protruding laterally from the concavity 18 as a part-cylindrical rib 21, which may be tubular as shown. In its relaxed state, the rib 21 protrudes a little above the horizontal tread 15 of the sill. The left or indoor side of the rib 21 is engaged and somewhat compressed by the door when in the closed condition as shown in FIG. 1, to seal against the bottom rail, and the stiles of the door.

A weatherboard 22, having a longitudinal bead 23 at its lowermost edges, overhangs the elastomeric rib 21 and the full width of the sill 10 so that rain which drips off the bead 23 tends to fall clear of the sill.

The underside of the weatherboard 22 is formed with a T section groove 24 which removably retains an elongate seal 25. The seal 25 extends along the weatherboard and, the seal 25, being of elastomeric material, resiliently supports the portion 26 which protrudes from the groove 24. The seal portion 26 is preferably tubular and part-cylindrical as shown.

When the door is open (the direction of opening being indicated by the arrow), a gap of course exists between the door and sill. When the door is in the closed condition as shown, the whole length of the seal portion 26 seals the gap by making resilient contact all along the rib 21, this closed position being indicated by 27 (FIG. 2) on the rib 21. The contact will move to the left through an intermediate position 28 on the rib 21 when the door is being opened. In passing through the intermediate position 28 the whole length of the seal portion 26 wipes the rib 21.

Should rain water have been blown up the sill 10 or on to the seal portion 26 and have collected at the top of the sill, the engagement between the portion 26 and rib 21 will prevent ingress of water under the door when closed position 27 is being occupied. The engagement will ordinarily not be broken by the wind because the seal portion 26 and the rib 21 are each of a diameter such that the door backs them up. Indeed the seal portion 26 and the rib 21 preferably seal against the door when it is in the closed condition. The wiping action between the seal portion 26 and rib 21 will minimise the water carried indoors by the seal when the door is being opened, water wiped from the seal portion 26 by the rib 21 tending to run on to the sill 10 and down the slope 16. The dimensions of the seal, rib and sill may differ from those in the drawing so that sealing in the closed position occurs between the portion 26 and the tread 15, and optionally between the portion 26 and the rib 21 also. When the door is being opened, wiping contact will first be made between the seal portion 26 and the rib 21 at the bottom of the stile which is furthest from the door hinge and will then progress towards the stile nearest the hinge. As the wiping contact area is small at any instant, the contact occurring only where the seal portion 26 intersects the rib 21 during hingeing movement of the door, the friction to be overcome in closing the door fully or opening it is minimal.

FIG. 3 shows sealing in the closed condition occurring at 27*a* between the seal portion 26 and the tread 15. The seal portion 26 is however making no contact with the rib 21 in the closed position but it will do so when the door is being opened.

FIG. 4 shows sealing in the closed condition occurring at 27*a* between the seal portion 26 and the tread 15, and also at 27*b* between the portion 26 and the rib 21. The rib 21 in FIG. 4 is formed on the sill 10, which is rigid and may be of metal or moulded plastics.

I claim:

1. In a sealing arrangement, a door mounted for hinging movement, a sill, a weatherboard carried by said door, an elongate seal supported along said weatherboard, said seal having a resiliently supporting protruding portion for sealing a gap between said weatherboard and said sill when said door is in a closed position, a rib provided on said sill, the rib being an elastomeric element retained by the sill, and extending along the sill and protruding therefrom, the rib further being arranged at the rear of the sill and sealing against the door when the door is in the closed condition, said protruding seal portion, during hinging movement of said door from the closed condition to the open condition, passing through an intermediate condition in which the seal portion traverses the rib in contact therewith so that the whole length of the seal portion is wiped by the rib.

2. A sealing arrangement according to claim 1, in which said seal portion seals against said rib when said door is in the closed condition.

3. A sealing arrangement according to claim 1, in which said seal portion seals against said sill when said door is in the closed condition.

4. A sealing arrangement according to claim 1, in which said seal is an elastomeric element.

5. A sealing arrangement according to claim 4, in which said portion of said seal which protrudes from said weatherboard is tubular.

6. A sealing arrangement according to claim 1 in which said seal is removably retained in a groove in the underside of said weatherboard, said seal portion protruding from the groove.

7. A sealing arrangement according to claim 1, in which said rib is an elastomeric element retained by said sill.

8. A sealing arrangement according to claim 7, in which said rib is tubular.

9. A sealing arrangement according to claim 1, in which said rib is formed on said sill.

10. A sealing arrangement according to claim 1 in which said rib is removably retained in a groove in said sill.

11. A sealing arrangement according to claim 1, in which said weatherboard overhangs the full width of said sill.

12. A sealing arrangement according to claim 1, in which said seal portion seals against said door when said door is in the closed condition.

13. A sealing arrangement according to claim 1, in which said seal is of neoprene.

14. A sealing arrangement according to claim 1, in which said rib is of neoprene.

15. A sealing arrangement according to claim 1, in which said sill is of rigid plastics material.

* * * * *